US009341387B2

(12) United States Patent
Cursetjee et al.

(10) Patent No.: US 9,341,387 B2
(45) Date of Patent: May 17, 2016

(54) ILLUMINATING AIRFLOW PANEL ASSEMBLY

(71) Applicant: Nortek Air Solutions, LLC, Eden Prairie, MN (US)

(72) Inventors: Zareer Cursetjee, Happy Valley, OR (US); David Baugh, Newberg, OR (US)

(73) Assignee: Nortek Air Solutions, LLC, Eden Prairie, MN (US)

( * ) Notice: Subject to any disclaimer, the term of this patent is extended or adjusted under 35 U.S.C. 154(b) by 248 days.

(21) Appl. No.: 13/905,812

(22) Filed: May 30, 2013

(65) Prior Publication Data

US 2014/0355248 A1 Dec. 4, 2014

(51) Int. Cl.
*F24F 13/078* (2006.01)

(52) U.S. Cl.
CPC ..... *F24F 13/078* (2013.01)

(58) Field of Classification Search
CPC ..... F24F 13/078
See application file for complete search history.

(56) References Cited

U.S. PATENT DOCUMENTS

| | | | | |
|---|---|---|---|---|
| 5,725,148 | A | 3/1998 | Hartman | |
| 6,551,185 | B1 | 4/2003 | Miyake | |
| 7,137,775 | B2 | 11/2006 | Hopkins | |
| 7,431,489 | B2 * | 10/2008 | Yeo et al. | 362/606 |
| 7,527,468 | B2 | 5/2009 | Hopkins | |
| 7,597,534 | B2 | 10/2009 | Hopkins | |
| 7,771,085 | B2 | 8/2010 | Kim | |
| 7,857,484 | B2 | 12/2010 | Marshall | |
| 7,914,252 | B2 | 3/2011 | Hopkins | |
| 7,922,442 | B2 | 4/2011 | Hopkins | |
| 8,087,877 | B2 | 1/2012 | Hopkins | |
| 8,770,340 | B2 | 7/2014 | Cursetjee | |
| 2002/0064038 | A1 * | 5/2002 | Kummerfeld | A61B 19/38 362/33 |
| 2010/0051563 | A1 | 3/2010 | Schreiber | |
| 2010/0053967 | A1 | 3/2010 | Bertram | |
| 2010/0136897 | A1 | 6/2010 | Lee | |

(Continued)

FOREIGN PATENT DOCUMENTS

| | | |
|---|---|---|
| JP | 5-31008 U | 4/1993 |
| JP | 6-5548 Y2 | 2/1994 |

(Continued)

OTHER PUBLICATIONS

International Application Serial No. PCT/US2014/040341, International Search Report mailed Sep. 24, 2014, 3 pgs.

(Continued)

*Primary Examiner* — Joseph L Williams
(74) *Attorney, Agent, or Firm* — Schwegman Lundberg & Woessner, P.A.

(57) ABSTRACT

An illuminating airflow panel assembly is configured to provide illumination and allow air to flow therethrough. The illuminating airflow panel assembly may include a mounting bracket configured to secure the illuminating airflow panel assembly to a structure, and a main body connected to the mounting bracket. The main body may include opposed first and second planar surfaces and an outer peripheral edge. The main body may also include a plurality of airflow passages that extend from the first planar surface to the second planar surface. The airflow passages are configured to allow air to pass therethrough toward a target site. An illuminating member may be positioned around the outer peripheral edge of the main body. The illuminating member is configured to direct light toward the target site.

25 Claims, 4 Drawing Sheets

(56) References Cited

U.S. PATENT DOCUMENTS

| | | | | |
|---|---|---|---|---|
| 2011/0014061 | A1 | 1/2011 | Hopkins et al. | |
| 2011/0058372 | A1* | 3/2011 | Lerman | H05K 1/0204 362/235 |
| 2011/0097986 | A1 | 4/2011 | Cursetjee et al. | |
| 2011/0156584 | A1 | 6/2011 | Kim | |
| 2011/0255296 | A1 | 10/2011 | Hashberger | |
| 2011/0255704 | A1 | 10/2011 | Hopkins | |
| 2013/0039074 | A1 | 2/2013 | Ding | |
| 2013/0344795 | A1* | 12/2013 | Schreiber | F24F 13/078 454/293 |
| 2014/0170958 | A1 | 6/2014 | Cursetjee | |
| 2014/0185305 | A1* | 7/2014 | Takahashi | F21V 29/02 362/373 |
| 2014/0191100 | A1 | 7/2014 | Cursetjee et al. | |
| 2015/0109765 | A1* | 4/2015 | Sepkhanov | E04B 1/86 362/147 |

FOREIGN PATENT DOCUMENTS

| | | | |
|---|---|---|---|
| JP | 9-158389 | A | 6/1997 |
| KR | 10-2006-0082597 | A | 7/2006 |
| WO | WO-2014/194258 | A1 | 12/2014 |

OTHER PUBLICATIONS

International Application Serial No. PCT/US2014/040341, Written Opinion mailed Sep. 24, 2014, 7 pgs.

Machine Translation of JP 5-31008U, publshed Apr. 23, 1993, 7 pgs.

Machine Translation of JP 6-5548, published Feb. 9, 1994, 4 pgs.

* cited by examiner

ILLUMINATING AIRFLOW PANEL ASSEMBLY

BACKGROUND OF THE DISCLOSURE

Embodiments of the present disclosure generally relate to panel assemblies, such as used with ceilings and plenums, and, more particularly, to illuminating airflow panel assemblies configured for use with ceilings, plenums, walls, overhead support modules that extend below a ceiling of a structure, and/or the like.

Certain interior environments, such as clean rooms, hospital-like operating rooms, radiology rooms, and dental suites, utilize extremely clean air in order to protect target sites and work therein. Electronic equipment may generate heat. As such, systems may be used that concentrate cool air within the vicinity of the heat-generating equipment. Individuals, such as surgeons, may also prefer to have available additional heated or cooled air in the immediate vicinity of an operating table in order to hold a patient at a stable temperature or dissipate the excess heat created by bright lamps or a team of doctors and nurses surrounding the patient. However, the needs of a given room may change over time, as new technology replaces what was originally installed, or the room is converted to different uses and configurations. Accordingly, it may be undesirable to have air conditioning and ventilation permanently installed as part of the structure of the building. Additionally, when multiple parties provide equipment for the internal spaces, there is typically significant coordination required during the design and construction phase to avoid scheduling and product conflicts. Therefore, modular systems that may be installed or removed with only minor structural alterations may be preferred and utilized.

Modular installation systems typically result in construction that is less expensive and more convenient. For example, ventilation structures need not be custom fabricated on-site, nor incorporated into the structure during construction. Instead, modular units may be mass-produced at an off-site factory and shipped to a location during construction. On-site fabrication may then be limited to fabrication and alterations as are necessary to attach the modular units to the frame of the building.

While modular systems often include airflow panels that allow conditioned or ventilated air to pass therethrough, the rooms in which the systems are positioned may also benefit from overhead lighting. Certain airflow panels may be replaced with lighting assemblies in order to provide illumination within the room. However, the lighting assemblies typically do not allow air to flow therethrough. As such, air delivery may be blocked to certain target sites within the room.

SUMMARY OF THE DISCLOSURE

Certain embodiments of the present disclosure provide an illuminating airflow panel assembly configured to provide illumination and allow air to flow therethrough. The illuminated airflow panel assembly may include a mounting bracket configured to secure the illuminating airflow panel assembly to a structure, a main body connected to the mounting bracket, and a first illuminating member. The main body connects to the mounting bracket, and may include opposed first and second planar surfaces, an outer peripheral edge, and a plurality of airflow passages that extend from the first planar surface to the second planar surface. The airflow passages are configured to allow air to pass therethrough toward a target site. The first illuminating member may be positioned around the outer peripheral edge of the main body and may be configured to direct light toward the target site.

Each of the plurality of airflow passages may be perpendicular to the opposed first and second planar surfaces. Further, each of the plurality of airflow passages may be aligned parallel to a direction of airflow through the main body.

The main body may also include one or more cooling vents in fluid communication with at least one of the plurality of airflow passages and connected to the first illuminating member. The cooling vent(s) are configured to direct a portion of the air onto the first illuminating member.

The first illuminating member may include a transparent housing containing at least one light emitting device. The light emitting device(s) may include at least one light emitting diode (LED). The first illuminating member may include one or more internal reflective surfaces configured to reflect light emitted by the at least one light emitting device throughout the transparent housing. The first illuminating device may include at least one light-directing member operatively connected to at least one light emitting device. The light-directing member(s) may include one or more of a lens, a light diffuser, or a reflective surface.

The airflow panel assembly may also include at least one second illuminating member secured on or between the opposed first and second planar surfaces. The second illuminating member may be configured to back-light the main body.

The first light emitting device may be embedded within the main body. One or both of the mounting bracket or the main body may include at least one reflective surface configured to direct light from the first light emitting device toward the target site. The assembly may also include a guard rail extending around at least a portion of the first light emitting device. An angle of the at least one reflective surface may be configured to be adjusted. The assembly may also include an adjustable shade positioned with respect to the first illuminating member.

The main body may also include at least one adjustable airflow modulator movably positioned with respect to the plurality of airflow passages. The adjustable airflow modulator(s) may be configured to be moved between fully open and fully closed positions.

Figure 1:
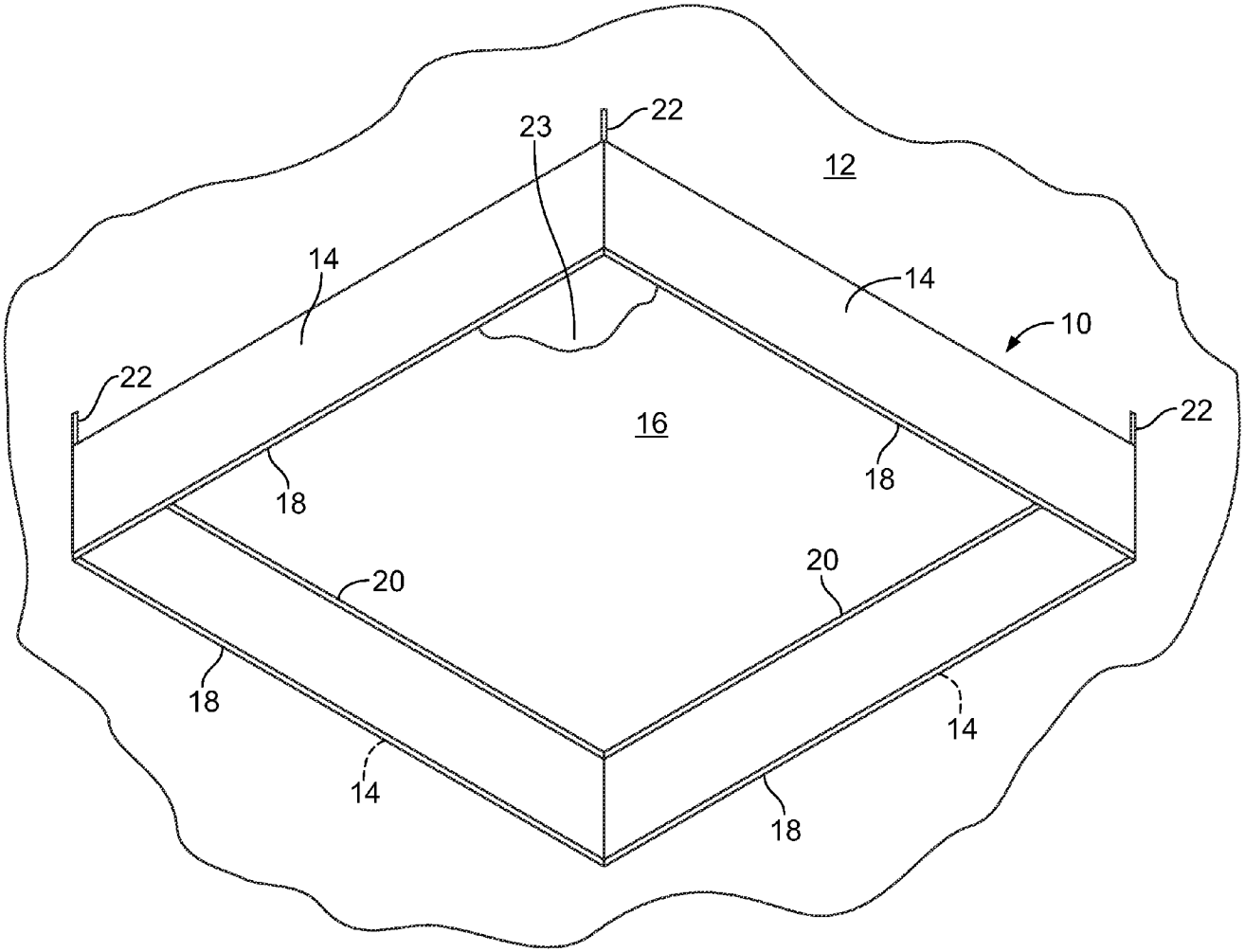
FIG. 1 illustrates an isometric bottom view of an overhead support module, according to an embodiment of the present disclosure.

Before the embodiments are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE DRAWINGS

Embodiments of the present disclosure provide illuminating airflow panel assemblies that are configured to be secured to a structure, such as a ceiling, wall, overhead module, or the like. The illuminating airflow panel assemblies may include illuminating members that are configured to provide illumination, while air passages within the assemblies allow air to flow therethrough. The airflow panel assemblies are configured to simultaneously provide air delivery and illumination. As such, airflow may be efficiently and evenly directed towards an illuminated target area.

FIG. 1 illustrates an isometric bottom view of an overhead support module 10, according to an embodiment of the present disclosure. The overhead support module 10 may be a plenum box module, or other such system that is configured to modularly secure to a ceiling 12 of a structure. The support module 10 may be configured to support an air handling unit, sprinkler systems, lighting systems, equipment, and the like. The support module 10 may be further described in U.S. Patent Application Publication No. 2011/0097986, entitled "Ceiling System With Integrated Equipment Support Structure," which is hereby incorporated by reference in its entirety. The overhead support module 10 is configured to be secured to a ceiling of an enclosed structure, such as clean room. As such, the overhead support module 10 is configured to be positioned over individuals within the enclosed structure. The overhead support module 10 defines an internal air delivery chamber that is in fluid communication with an air delivery system, such as an air handling unit. Conditioned air from the air handling unit is passed to the air delivery chamber, and into the enclosed structure through one or more air delivery outlets formed in the overhead support module 10. Thus, the overhead support module is configured to deliver conditioned air to the enclosed structure.

The overhead support module 10 may form a plenum that includes outer walls 14 that define an internal chamber 16. The outer walls 14 may connect together at right angles, and form a generally square or rectangular structure, as shown. However, the outer walls 14 may be various other shapes and sizes, such as circular, elliptical, triangular, trapezoidal, or the like.

The outer walls 14 may be formed of metal, such as sheet steel, for example. However, the outer walls may be formed of various other materials, such as reinforced plastic. In general, the outer walls 14 are configured to accommodate heating and cooling needs of the structure, as well as to securely attach to the ceiling 12. Each of the outer walls 14 may include a lower lip 18 and a support beam 20, which may be located at upper portions of the outer walls 14. The upper support beam 20 may be formed as a rectangular member, such as a rectangular beam, tube, or the like.

While not shown in FIG. 1, grid members may be attached to the lower lip 18, and form a grid of supports for the ordinary parts of a suspended ceiling, such as ceiling tiles, panel assemblies, lights, and vents for air passage (not shown). Alternatively, grid members may be attached to other portions of the outer walls 14. The grid members may be formed as rectangular tubes or U-shaped channels of stainless steel, or extruded aluminum, but may be constructed of other materials and in other shapes as well. The grid members are rigid in order to span the overhead support module 10 without additional support. The grid members may also be attached to the building structure, for instance by the use of hangers, for greater load-bearing capacity. Alternatively, the overhead support module 10 may not include grid members, but may, instead, simply include the outer walls 14, as shown.

A clean room barrier 23 may form a suspended ceiling and extend from the outer walls 14 proximate the lower lip 18 of the overhead support module 10. In order to clearly show the structure of the overhead support module 10, only a portion of the clean room barrier 23 is shown in FIG. 1. The clean room barrier 23 separates the internal chamber 16 from a clean room into which the overhead support module 10 is secured. The clean room barrier 23 may be formed by one or more illuminating airflow panel assemblies, as described below. The internal chamber 16 may provide an air delivery chamber that is configured to convey air, such as air conditioned by an air handling system, to the internal space of the clean room. For example, the internal chamber 16 may be in communication with an output of an air handling unit that is configured to provide conditioned air to the clean room. An air outlet may be secured to or formed through a portion of the clean room barrier 23 to allow conditioned air to pass from the overhead support module 10 into the clean room.

The overhead support module 10 may be sealed at the top by a sealing wall or roof in order to control airflow. The sealing wall or roof may be formed of sheet metal, plastic, or the like. A hole may be formed in the sealing wall and/or the outer walls 14 to permit air to enter or leave the overhead support module 10, and therefore the room. An air handling component (not shown) may be mounted adjacent the hole(s), or may be operatively connected to a duct (not shown) that connects to the hole(s). Alternatively, the overhead support module 10 may have an air handling component mounted directly thereto. The overhead support module 10 may receive supply air from various types of HVAC and air handling systems.

The overhead support module 10 may be suspended from the ceiling 12 by hangers 22, which may in turn attach directly to I-beams or other frame members of the building. The hangers 22 may also be attached to a secondary structure (not shown) which in turn attaches to the frame of the building. Alternatively, the overhead support module 10 may also be bolted directly to part of the building or an adapter rather than suspended from hangers 22. As shown in FIG. 1, the hangers 22 may be at the corners of overhead support module 10, but may be placed in other locations, or with greater spatial frequency than shown.

Figure 2:
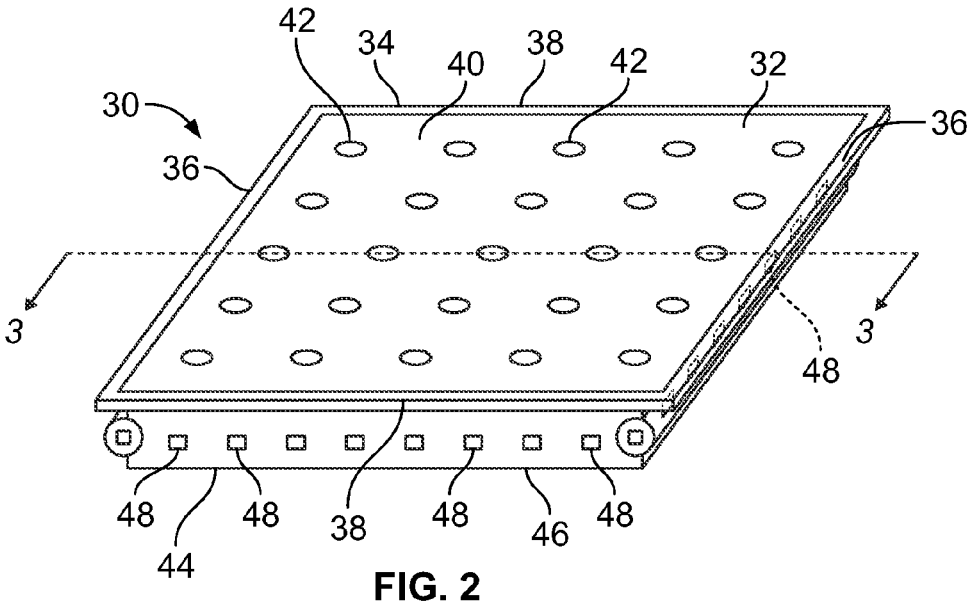
FIG. 2 illustrates an isometric top view of an illuminating airflow panel assembly, according to an embodiment of the present disclosure.

FIG. 2 illustrates an isometric top view of an illuminating airflow panel assembly 30, according to an embodiment of the present disclosure. The assembly 30 may be used with respect to the overhead support module 10. For example, the assembly 30 may be secured to the outer walls 14 and/or grid member. As such, one or more assemblies 30 may form a ceiling or covering surface for the overhead support module 10. The assembly 30 is configured to provide illumination and airflow into a room in which the overhead support module 10 is located. Optionally, the assembly 30 may be directly secured to a ceiling structure, plenum, wall, floor, or the like, instead of the overhead support module 10.

The assembly 30 includes a main body 32 secured to a peripheral mounting bracket 34. The bracket 34 includes opposed ends 36 connected to opposed sides 38. The opposed ends 36 and the opposed sides 38 may be formed of a metal or plastic. Additionally, the opposed ends 36 and the opposed sides 38 may be integrally molded and formed as a unitary piece, or may be separately secured to one another such as through fasteners, adhesives, joints, and/or the like. As shown, the peripheral mounting bracket 34 forms a generally rectangular structure. However, the peripheral mounting bracket 34 may be sized and shaped differently. For example, the peripheral mounting bracket 34 may be circular, triangular, or irregularly-shaped. The peripheral mounting bracket 34 is configured to allow the assembly 30 to be secured to a structure, such as a grid support system of an overhead support module 10. Accordingly, the size and shape of the peripheral mounting bracket 34 may be determined by the size, shape, and dimensions of the structure to which the peripheral mounting bracket 34 is to be secured.

While shown at the top of the assembly 10, the peripheral mounting bracket 34 may be located at various other areas around the periphery of the assembly 10. For example, the peripheral mounting bracket 34 may alternatively be located proximate to a bottom of the assembly 10. Alternatively, the peripheral mounting bracket 34 may extend from an area that is proximate to a mid-plane of the assembly 10. Further, a bracket configured to attach the assembly 10 to a structure may not be utilized. For example, the assembly 10 may not include the peripheral mounting bracket 34. Instead, another mounting bracket system, assembly, or device may be used to secure the assembly 10 to a structure.

As shown in FIG. 2, a top of the main body 32 may be secured to and contained within the peripheral mounting bracket 34. In at least one embodiment, the main body 32 may be secured to the peripheral mounting bracket 34 through fasteners, adhesives, bonding, and/or the like. The main body 32 may be formed of various material, such as plastic, metal, open-cell foam, closed-cell foam, rubber, various acoustic-dampening materials, and/or the like. The main body 32 may be opaque, fully transparent, or semi-transparent. In general, the main body 32 may be formed of materials such as those that typically form various ceiling tiles. The main body 32 may include insulative and sound-absorptive materials, such as described in U.S. patent application Ser. No. 13/297,690, filed Nov. 16, 2011, entitled "Sound-Absorptive Panel for an Air Handling System," which is hereby incorporated by reference in its entirety.

The main body 32 includes a planar upper surface 40 integrally connected to a planar lower surface (hidden from view in FIG. 1). The size and shape of the main body 32 may be rectangular, or various other sizes and shapes. A plurality of airflow passages 42 are formed through the main body 32. Each airflow passage 42 extends from the upper surface 40 to the lower surface, and may be linear. For example, each airflow passage 42 may extend from the upper surface 40 to the lower surface in a direction that is perpendicular to the upper surface 40 and the lower surface. Optionally, the airflow passages 42 may extend at angles through the main body 32, and/or may be curved. However, the linear shape and perpendicular orientation of the airflow passages 42 with respect to the upper surface 40 and the lower surface provides the shortest path from the upper surface 40 to the lower surface, thereby providing a direct, quick and efficient route for airflow to pass therethrough. Further, because the airflow passages 42 may be perpendicular to the upper surface 40 and the lower surface, the airflow passages 42 may be aligned parallel with respect to the direction of airflow through the assembly 30.

The main body 32 may include any number of airflow passages 42. While FIG. 2 shows twenty-five airflow passages 42, more or less airflow passages 42 may be formed through the main body 32. Moreover, the diameters of the airflow passages 42 may be various shapes and sizes. For example, the diameter of each airflow passage 42 may range from 1-10 mm. However, the diameter of each airflow passage 42 may be less than 1 mm or greater than 10 mm.

The assembly 30 also includes an illuminating member 44 positioned around a periphery of the main body 32. The illuminating member 44 may be secured around an outer peripheral edge of the main body 32 and underneath the peripheral mounting bracket 34. The illuminating member 44 may be secured to the main body 32 and/or the peripheral mounting bracket 34 through fasteners, adhesives, bonding, and/or the like.

The illuminating member 44 may be include a transparent housing 46 configured to allow light to pass therethrough. The transparent housing 46 may be a lens formed of various materials, such as glass, plexi-glass, transparent plastic, and/or the like. The transparent housing 46 may have a tubular cross-section. Optionally, the cross-section of the transparent housing 46 may be various other shapes and sizes, such as rectangular, triangular, or the like. The transparent housing 46 may be fully transparent, or may be tinted or shaded in order to reduce the intensity of emitted light. The transparent housing 46 may include one or more light or color filters, such as ultraviolet filters. Optionally, one or more light emitting devices 48 housed within the transparent housing 46 may include one more light or color filters.

The transparent housing 46 contains the light-emitting devices 48, such as light-emitting diodes (LEDs). The light-emitting devices 48 may be operatively connected to a source of power and a switch (not shown). For example, the light-emitting devices 48 may be operatively connected to an electronic circuit (not shown) secured on or within the main body 32. The electronic circuit may, in turn, be connected to a source of power, such as an outlet of AC power or battery (not shown), and a switch that allows the light-emitting devices 48 to be turned on and off. While FIG. 2 shows the illuminating member 44 having numerous light-emitting devices 48, more or less light-emitting device 48 may be housed within the transparent housing 46. For example, instead of multiple light-emitting devices 48, the transparent housing 46 may contain a single light-emitting device 48 that is configured to illuminate light that is reflected through the transparent housing by one or more reflective surfaces. Also, alternatively, a single light emitting device may extend through the transparent housing 46 so that it surrounds the main body 32.

In operation, the assembly 30 is configured to allow air to flow through the airflow passages 42 from the upper surface 40 to the lower surface. At the same time, the assembly 30 is configured to provide illumination through the illuminating member 44. The illuminating member 44 may be configured to direct light from the light-emitting devices 48 toward a target site in the same direction that the air flows through the airflow passages 42.

Figure 3:
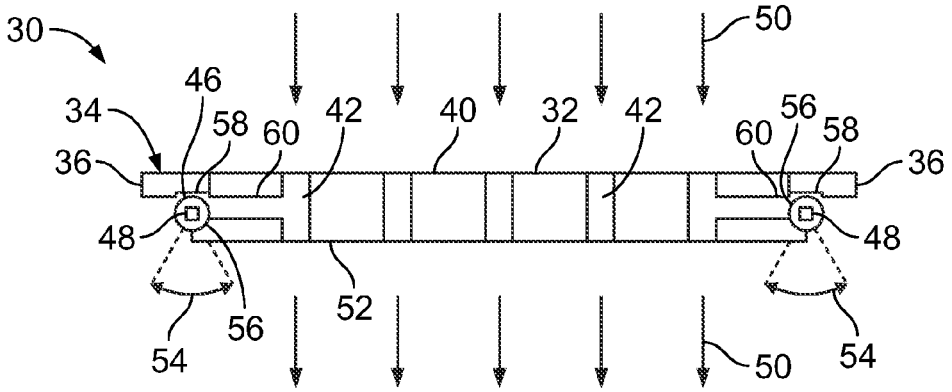
FIG. 3 illustrates a cross-sectional view of an illuminating airflow panel assembly through line 3-3 of FIG. 2, according to an embodiment of the present disclosure.

FIG. 3 illustrates a cross-sectional view of the illuminating airflow panel assembly 30 through line 3-3 of FIG. 2, according to an embodiment of the present disclosure. As shown in FIG. 3, the peripheral mounting bracket 34 extends over and past the illuminating member 44. As such, the peripheral mounting bracket 34 may overlay a portion of a support structure, such as a grid support assembly of an overhead support module. In this manner, the peripheral mounting bracket 34 may secure the assembly 30 to the support structure. Optionally, fasteners or adhesives may be used to further secure the peripheral mounting bracket 34 to the support structure.

Each airflow passage 42 may be coated, or surrounded or lined with an opaque material that prevents light from passing therethrough. Optionally, the airflow passages 42 may not be coated, or surrounded or lined with the opaque material.

In operation, air 50 passes directly through the airflow passages 42 from the upper surface 40 of the main body 32 to the lower surface 52. The air 50 passes through the airflow passages 42 in a direction that is generally linear and perpendicular to the upper and lower surfaces 40 and 52. At the same time, the illuminating member 44, which is positioned around an outer peripheral, circumferential, or perimeter edge 56 of at least a portion of the main body 32, emits light 54 in the same direction as the flow of air 50. Lower surfaces 58 of the peripheral mounting bracket 34 may include reflective surfaces (such as mirrors, reflective metals, or the like) that are configured to reflect and re-direct emitted light toward a target area.

The assembly 30 allows airflow to pass therethrough. At the same time, the assembly 30 is capable of providing illumination to a target site. As such, the assembly 30 does not hinder directed-airflow towards a target site at the expense of illumination, or vice versa.

Additionally, the airflow passages 42 next to the illuminating member 44 may include cooling vents 60 that allow air to be re-directed to the illuminating member 44. The cooling vents 60 are in fluid communication with at least one of the airflow passages 42 and connect to the illuminating member 44. As the air 50 passes through airflow passages 42, some of the air 50 is directed into the cooling vents 60 and onto the illuminating member 44. Therefore, the cooling vents 60 allow the illuminating member 44 to be cooled during operation.

Figure 4:
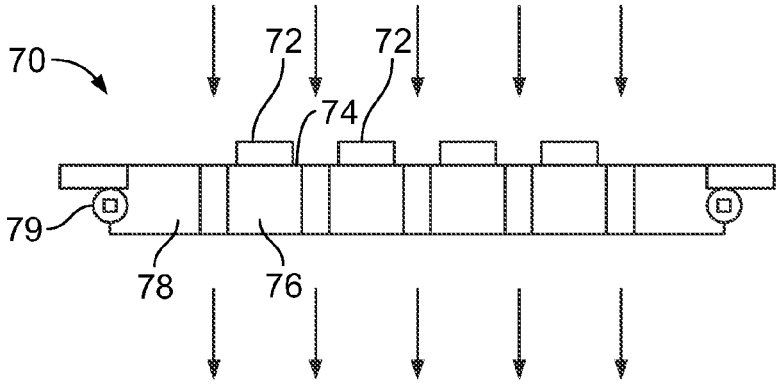
FIG. 4 illustrates a cross-sectional view of an illuminating airflow panel assembly, according to an embodiment of the present disclosure.

FIG. 4 illustrates a cross-sectional view of an illuminating airflow panel assembly 70, according to an embodiment of the present disclosure. The assembly 70 is similar to the assembly 30, except that additional illuminating members 72 may be positioned on the upper surface 74 of the main body 76 between the airflow passages 78. In this embodiment, the main body 76 may be at least partially transparent. The illuminating members 72 are configured to direct light through the main body 76 so that the assembly 70 is back-lit in addition to being edge-lit by the illuminating member 79. The illuminating members 72 may include LEDs.

Figure 5:
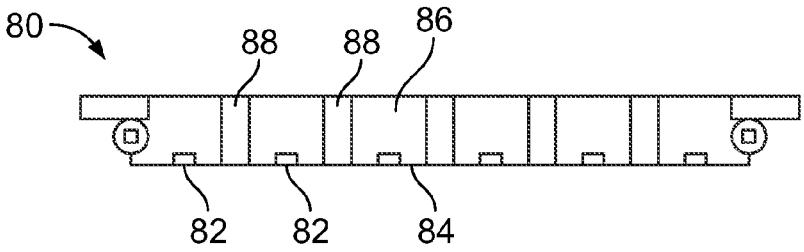
FIG. 5 illustrates a cross-sectional view of an illuminating panel assembly, according to an embodiment of the present disclosure.

FIG. 5 illustrates a cross-sectional view of an illuminating panel assembly 80, according to an embodiment of the present disclosure. The assembly 80 is similar to the assemblies 30 and 70, except that additional illuminating members 82 may be disposed proximate to the lower surface 84 of the main body 86 and positioned between the air passages 88. In this embodiment, the main body 86 may be formed of an opaque material, as the illuminating members 82 are able to emit light that passes out of the lower surface 84 without having to pass through the main body 86 itself.

Figure 6:
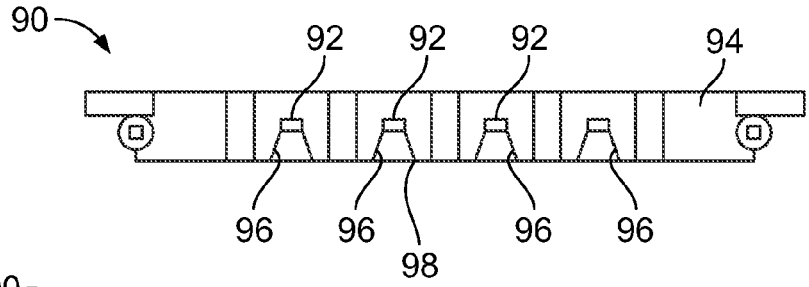
FIG. 6 illustrates a cross-sectional view of an illuminating airflow panel assembly, according to an embodiment of the present disclosure.

FIG. 6 illustrates a cross-sectional view of an illuminating airflow panel assembly 90, according to an embodiment of the present disclosure. The assembly 90 is similar to the assemblies 30 and 70, except that additional illuminating members 92 may be recessed within the main body 94. The illuminating members 92 may connect to light-directing members 96, such as lenses, light diffusers, reflective surfaces, or the like that extend through the lower surface 98 of the main body 94. Accordingly, emitted light from the additional illuminating members 92 may pass out of the lower surface 98 of the main body 94.

Figure 7:
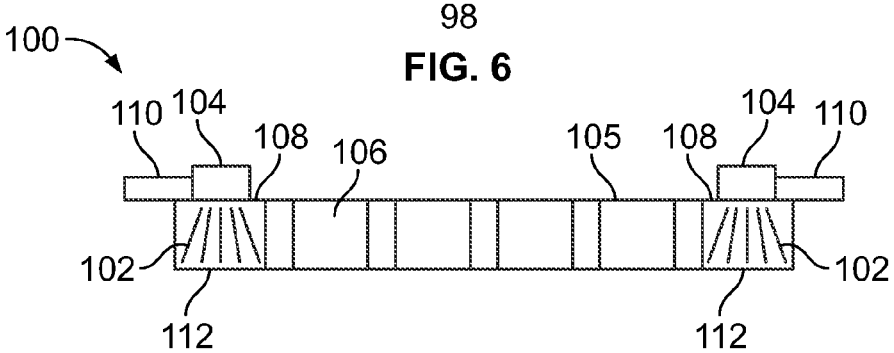
FIG. 7 illustrates a cross-sectional view of an illuminating airflow panel assembly, according to an embodiment of the present disclosure.

FIG. 7 illustrates a cross-sectional view of an illuminating airflow panel assembly 100, according to an embodiment of the present disclosure. The assembly 100 is similar to the assembly 30, except that the assembly 100 includes an illuminating member 102 having light-emitting devices 104 that extend through the upper surface 105 of the main body 106 proximate to a peripheral edge 108 and the peripheral mounting bracket 110. The light-emitting devices 104 are operatively connected to light-directing members 112, such as lenses, light diffusers, reflective surfaces, or the like, that are configured to direct emitted light out toward a target site.

Figure 8:
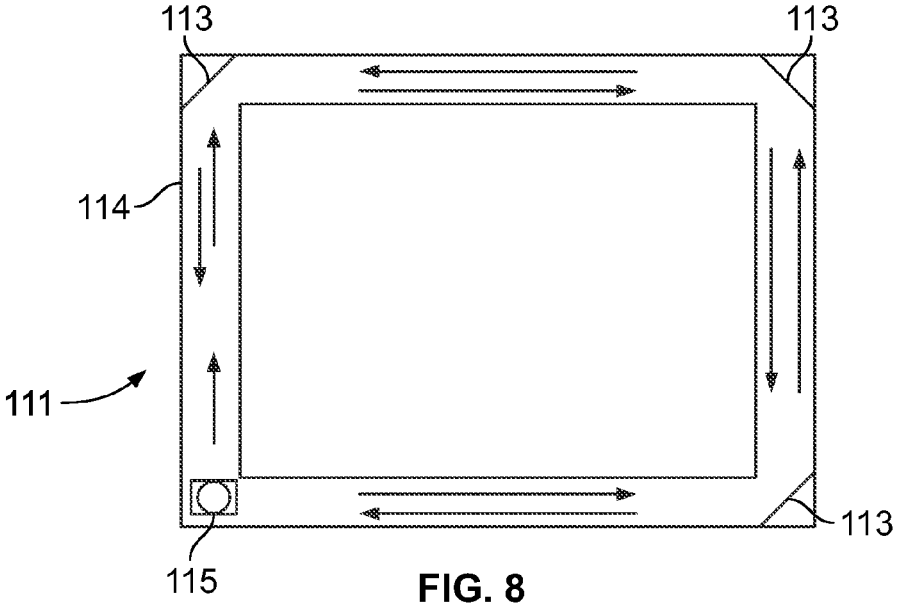
FIG. 8 illustrates a top plan view of an illuminating member, according to an embodiment of the present disclosure.

FIG. 8 illustrates a top plan view of an illuminating member 111, according to an embodiment of the present disclosure. As noted above with respect to FIG. 2, the illuminating member 44 may include a plurality of light emitting devices. However, the illuminating member 111 may include a single light-emitting device 115, such as an LED, and a plurality of reflective surfaces 113, such as mirrors, within the transparent housing 114. Light emitted from the light-emitting device 115 reflects off the reflective surfaces 113 through the length of the transparent housing 114, thereby providing illumination throughout the illuminating member 111. In this manner, a single light-emitting device 115 may be used to provide illumination throughout the illuminating member 111. Optionally, the illuminating member 111 may include additional light-emitting devices. The illuminating member 111 may be used with any of the embodiments described above.

Figure 9:
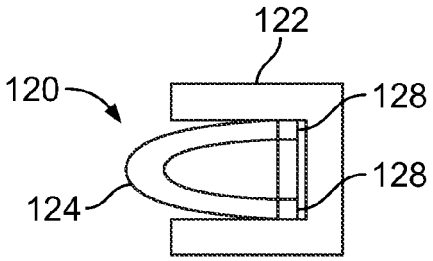
FIG. 9 illustrates a cross-sectional view of an illuminating member, according to an embodiment of the present disclosure.

FIG. 9 illustrates a cross-sectional view of an illuminating member 120, according to an embodiment of the present disclosure. The illuminating member 120 may be secured within a bracket 122 that is configured to be secured to a main body or peripheral mounting bracket of any of the assemblies described above. The illuminating member 120 may include a transparent housing 124 having a shaped-lens diffuser 126, which may be parabolic or circular shaped, for example. One or more light-emitting devices 128 are configured to emit light through the diffuser 126, which diffuses the emitted light based on the shape of the diffuser 126. The illuminating member 120 may outwardly extend from peripheral edges of a main body. Optionally, the illuminating member 120 may downwardly extend from the main body. The illuminating member 120 may be used with any of the embodiments described above.

Figure 10:
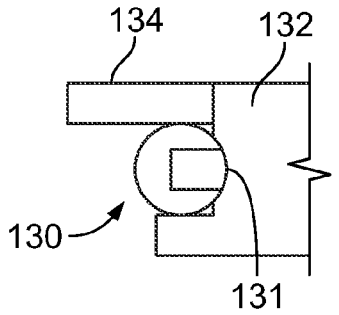
FIG. 10 illustrates a cross-sectional view of an illuminating member, according to an embodiment of the present disclosure.

FIG. 10 illustrates a cross-sectional view of an illuminating member 130, according to an embodiment of the present disclosure. The illuminating member 130 may extend outwardly from a peripheral edge 131 of a main body 132. A portion of the main body 132 may underlie a portion of the illuminating member 130 to provide additional support. As shown, the illuminating member 130 may be positioned below a peripheral mounting bracket 134, which may include a reflective surface or coating configured to reflect and redirect emitted light.

Figure 11:
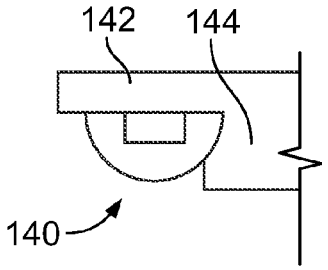
FIG. 11 illustrates a cross-sectional view of an illuminating member, according to an embodiment of the present disclosure.

FIG. 11 illustrates a cross-sectional view of an illuminating member 140, according to an embodiment of the present disclosure. As shown, the illuminating member 140 may extend downwardly from a peripheral mounting bracket 142 without any portion of a main body 144 below the illuminating member 140.

Figure 12:
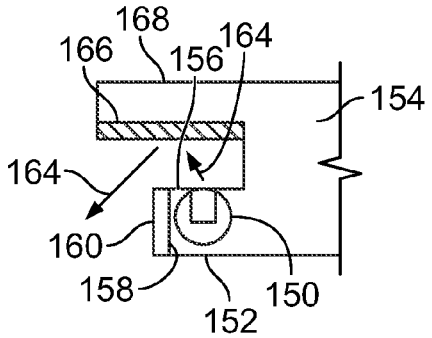
FIG. 12 illustrates a cross-sectional view of an illuminating member, according to an embodiment of the present disclosure.

FIG. 12 illustrates a cross-sectional view of an illuminating member 150, according to an embodiment of the present disclosure. The illuminating member 150 is contained within a peripheral edge 152 of a main body 154. As shown, only the top surface 156 of the illuminating member 150 is exposed. The illuminating member 150 may be embedded within the main body 154, as shown in FIG. 12. The outer peripheral edge 158 of the illuminating member 150 may be shielded by a guard rail 160 that extends along a length of the main body 154. The guard rail 160 may be transparent, semi-transparent, or opaque. The guard rail 160 protects the illuminating member 150 from being damaged. The illuminating member 150 emits light 164 that is reflected off a reflective surface 166 of the peripheral mounting bracket 168 towards a target site. The reflective surface 166 may be set at a desired angle to direct light at a desired focus toward the target site. The reflective surface 166 may be secured to a pivotal base that allows the angle to be varied. For example, an individual may manually alter the angle of the reflective surface 166. Optionally, the pivotal base may be operatively connected to a hinge or pivot member, which, in turn, is operatively connected to an actuator that allows the angle of the reflective surface to be automatically adjusted.

Figure 13:
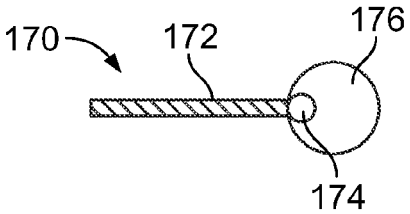
FIG. 13 illustrates a schematic diagram of an adjustable reflective surface, according to an embodiment of the present disclosure.

FIG. 13 illustrates a schematic diagram of an adjustable reflective surface 170, according to an embodiment of the present disclosure. The reflective surface 170 includes a base 172 operatively connected to an adjuster 174, such as a pivot or hinge 174, which is in turn operatively connected to an actuator 176, such as a motor. The actuator 176 may be operatively connected to an electronic circuit within an assembly, such as any of the assemblies described above. Optionally, the actuator 176 may not be used. In operation, the angle of the reflective surface 170 may be altered by moving the adjuster 174. As such, the focus of light reflected off the reflective surface 170 may be changed. The adjustable reflective surface 170 may be used with any of the embodiments described above.

Figure 14:
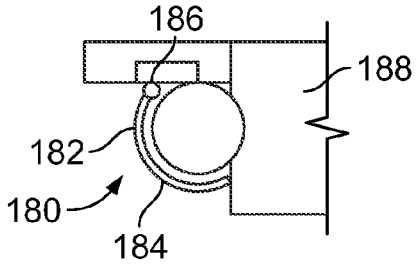
FIG. 14 illustrates a cross-sectional view of an illuminating member, according to an embodiment of the present disclosure.

FIG. 14 illustrates a cross-sectional view of an illuminating member 180, according to an embodiment of the present disclosure. The illuminating member 180 may include an adjustable shade 182 positioned over an exposed portion thereof. The adjustable shade 182 may be semi-transparent or opaque. The adjustable shade 182 may include a curved flap 184 that may be configured to be wound and unwound around a spool 186 in order to selectively shade and un-shade the illuminating member 180. The spool 186 may be operatively connected to an actuator, such as a motor, which is connected to an electronic circuit on or within a main body 188. The illuminating member 180 may be used with any of the embodiments described above.

Figure 15:
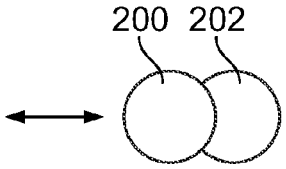
FIG. 15 illustrates a bottom plan view of an airflow modulator movably secured to an airflow passage, according to an embodiment of the present disclosure.

FIG. 15 illustrates a bottom plan view of an airflow modulator 200 movably secured to an airflow passage 202, according to an embodiment of the present disclosure. The airflow modulator 200 may be movably secured within a main body of an illuminating airflow panel assembly, such as any of those described above. The airflow modulator 200 may be a planar piece of material configured to slide over and away from the airflow passage 202, in order to vary the amount of airflow through the airflow passage 202. For example, the airflow modulator may include a sheet having a plurality of holes formed through. When the holes of the sheet are aligned within the airflow passages 202, air is able to pass through the airflow passages. When the holes of the sheet are not aligned with the airflow passages 202 such that solid material of the sheet is disposed within the airflow passages 202, air is prevented from moving through the airflow passages 202. The sheet may be modulated between fully open and fully closed positions in order to vary the amount of airflow through the airflow passages 202. The airflow modulator(s) 200 may be various shapes, sizes, and configurations configured to selectively open and close the airflow passages 202. The airflow modulator(s) 200 may be manually or automatically operated. The airflow modulator(s) 200 may be used with any of the embodiments described above.

Embodiments of the present application may be used with air handling systems and fan arrays. Air handling systems and fan arrays are further described and shown, for example, in U.S. Pat. No. 7,527,468, entitled "Fan Array Fan Section In Air-Handling Systems," U.S. Pat. No. 7,922,442, entitled "Fan Array Fan Section In Air Handling Systems," U.S. Pat. No. 7,914,252, entitled "Fan Array Fan Section In Air Handling Systems," U.S. Pat. No. 7,597,534, entitled "Fan Array Fan Section In Air Handling Systems," U.S. Pat. No. 8,087,877, entitled "Fan Array Fan Section In Air Handling Systems," U.S. Patent Application Publication No. 2011/0014061, entitled "Fan Array Control System," and U.S. Patent Application No. 2011/0255704, entitled "Methods and Systems for Active Sound Attenuation In An Air Handling Unit," all of which are hereby incorporated by reference in their entireties. Embodiments of the present disclosure may be used with various air handling or processing systems.

Embodiments of the present disclosure may be used with respect to an operating and/or clean room. Additionally, embodiments of the present disclosure may be used in various other settings. For example, the illuminated airflow panel assemblies may be used with respect to data centers, such as shown and described in United States Patent Application Publication No. 2010/0051563, entitled "Modular Data Center," which is hereby incorporated by reference in its entirety.

Embodiments of the present disclosure may include, or be used with, air filter assemblies, such as described in U.S. patent application Ser. No. 13/717,826, filed Dec. 18, 2012, entitled "Air Filter Assembly," which is hereby incorporated by reference in its entirety. For example, any of the assemblies described above may be used as a panel of an air filter assembly.

Further, embodiments of the present disclosure may be used with respect to equipment boom assemblies, such as described in U.S. patent application Ser. No. 13/737,197, filed Jan. 9, 2013, entitled "Adjustable Equipment Mount Assembly for an Overhead Support Module," and U.S. patent application Ser. No. 13/682,339, filed Nov. 20, 2012, entitled "System and Method for Delivering Air Through a Boom Assembly," both of which are hereby incorporated by reference in their entireties.

As described above, embodiments of the present disclosure provide illuminating airflow panel assemblies that are configured to simultaneously provide air delivery and illumination to a target site. As such, airflow may be efficiently and evenly directed towards an illuminated target area. The illuminating airflow panel assemblies may be secured to ceilings, plenums, overhead support modules, walls, and floors.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An illuminating airflow panel assembly configured to provide illumination and allow air to flow therethrough, the illuminated airflow panel assembly comprising:

a mounting bracket configured to secure the illuminating airflow panel assembly to a structure;

a main body connected to the mounting bracket, the main body comprising:

opposed first and second planar surfaces;

an outer peripheral edge; and a plurality of airflow passages extending from the first planar surface to the second planar surface, wherein the plurality of airflow passages are configured to allow air to pass through the main body from the opposed first planar surface to the second planar surface toward a target site; and a first illuminating member positioned around the outer peripheral edge of the main body, wherein the first illuminating member is configured to direct light toward the target site.

2. The illuminating airflow panel assembly of claim 1, wherein each of the plurality of airflow passages is perpendicular to the opposed first and second planar surfaces.

3. The illuminating airflow panel assembly of claim 1, wherein the main body further comprises one or more cooling vents in fluid communication with at least one of the plurality of airflow passages and connected to the first illuminating member, wherein the one or more cooling vents are configured to direct a portion of the air onto the first illuminating member.

4. The illuminating airflow panel assembly of claim 1, wherein the first illuminating member comprises a transparent housing containing at least one light emitting device.

5. The illuminating airflow panel assembly of claim 4, wherein the at least one light emitting device comprises at least one light emitting diode (LED).

6. The illuminating airflow panel assembly of claim 4, wherein the first illuminating member comprises one or more internal reflective surfaces configured to reflect light emitted by the at least one light emitting device throughout the transparent housing.

7. The illuminating airflow panel assembly of claim 4, wherein the first illuminating device comprises at least one light-directing member operatively connected to at least one light emitting device.

8. The illuminating airflow panel assembly of claim 7, wherein the at least one light-directing member comprises one or more of a lens, a light diffuser, or a reflective surface.

9. The illuminating airflow panel assembly of claim 1, further comprising at least one second illuminating member secured on or between the opposed first and second planar surfaces.

10. The illuminating airflow panel assembly of claim 1, wherein the first light emitting device is embedded within the main body, and wherein one or both of the mounting bracket or the main body comprises at least one reflective surface configured to direct light from the first light emitting device toward the target site.

11. The illuminating airflow panel assembly of claim 1, further comprising a guard rail extending around at least a portion of the first light emitting device.

12. The illuminating airflow panel assembly of claim 10, wherein an angle of the at least one reflective surface is configured to be adjusted.

13. The illuminating airflow panel assembly of claim 1, further comprising an adjustable shade positioned with respect to the first illuminating member.

14. The illuminating airflow panel assembly of claim 1, wherein the main body further comprises at least one adjustable airflow modulator movably positioned with respect to the plurality of airflow passages, and wherein the at least one adjustable airflow modulator is configured to be moved between fully open and fully closed positions.

15. An illuminating airflow panel assembly configured to provide illumination and allow air to flow therethrough, the illuminated airflow panel assembly comprising:

a peripheral mounting bracket comprising opposed ends connected to opposed sides, wherein the peripheral mounting bracket is configured to secure the illuminating airflow panel assembly to a structure;

a main body connected to the peripheral mounting bracket, the main body comprising:

opposed first and second planar surfaces;

an outer peripheral edge, wherein at least a portion of the first planar surface is retained between the opposed ends and the opposed sides of the peripheral mounting bracket, and a plurality of airflow passages that extend from the first planar surface to the second planar surface, wherein the plurality of airflow passages are configured to allow air to pass through the main body from the opposed first planar surface to the second planar surface toward a target site, wherein each of the plurality of airflow passages is perpendicular to the opposed first and second planar surfaces, and wherein each of the plurality of airflow passages is aligned parallel to a direction of airflow through the main body; and a first illuminating member positioned around the outer peripheral edge of the main body, wherein the first illuminating member is configured to direct light toward the target site, wherein the first illuminating member comprises a transparent housing containing at least one light emitting diode (LED).

16. The illuminating airflow panel assembly of claim 15, wherein the main body further comprises one or more cooling vents in fluid communication with at least one of the plurality of airflow passages and connected to the first illuminating member, wherein the one or more cooling vents are configured to direct a portion of the air onto the first illuminating member.

17. The illuminating airflow panel assembly of claim 15, wherein the first illuminating member comprises one or more internal reflective surfaces configured to reflect light emitted by the at least one light emitting diode throughout the transparent housing.

18. The illuminating airflow panel assembly of claim 15, wherein the first illuminating device comprises at least one light-directing member operatively connected to at least one light emitting device.

19. The illuminating airflow panel assembly of claim 18, wherein the at least one light-directing member comprises one or more of a lens, a light diffuser, or a reflective surface.

20. The illuminating airflow panel assembly of claim 15, further comprising at least one second illuminating member secured on or between the opposed first and second planar surfaces.

21. The illuminating airflow panel assembly of claim 15, wherein the first light emitting device is embedded within the main body, and wherein one or both of the mounting bracket or the main body comprises at least one reflective surface configured to direct light from the first light emitting device toward the target site.

22. The illuminating airflow panel assembly of claim 15, further comprising a guard rail extending around at least a portion of the first light emitting device.

23. The illuminating airflow panel assembly of claim 21, wherein an angle of the at least one reflective surface is configured to be adjusted.

24. The illuminating airflow panel assembly of claim 15, further comprising an adjustable shade positioned with respect to the first illuminating member.

25. The illuminating airflow panel assembly of claim 15, wherein the main body further comprises at least one adjustable airflow modulator movably positioned with respect to the plurality of airflow passages, and wherein the at least one adjustable airflow modulator is configured to be moved between open and closed positions.

* * * * *